US006622649B1

(12) United States Patent
Shaw

(10) Patent No.: US 6,622,649 B1
(45) Date of Patent: Sep. 23, 2003

(54) WIND ACCESSORY FOR TETHERED DISPLAY DEVICE

(75) Inventor: Matthew H. Shaw, Seattle, WA (US)

(73) Assignee: Electronic Programming and Design, Inc., Seattle, WA (US)

( * ) Notice: Subject to any disclaimer, the term of this patent is extended or adjusted under 35 U.S.C. 154(b) by 0 days.

(21) Appl. No.: 09/137,943

(22) Filed: Aug. 21, 1998

Related U.S. Application Data

(63) Continuation-in-part of application No. 08/674,651, filed on Jun. 25, 1996, now Pat. No. 5,826,535.

(51) Int. Cl.[7] ..... G09F 17/00
(52) U.S. Cl. ..... 116/173; 40/218
(58) Field of Search ..... 116/173, 174, 116/63 P, 63 R, DIG. 7, DIG. 8; 40/212, 214, 215, 218, 602, 477

(56) References Cited

U.S. PATENT DOCUMENTS

| | | | | | |
|---|---|---|---|---|---|
| 1,102,270 | A | | 7/1914 | Howard | |
| 1,255,580 | A | | 2/1918 | Brown | |
| 1,256,232 | A | * | 2/1918 | Howard | 116/173 |
| 1,270,813 | A | | 7/1918 | Gowen | |
| 1,294,032 | A | | 2/1919 | Bixby | |
| 1,337,237 | A | * | 4/1920 | Light | 116/173 |
| 1,339,849 | A | | 5/1920 | Johnson et al. | |
| 1,646,467 | A | | 10/1927 | Walton | |
| 1,648,934 | A | * | 11/1927 | Brinkmann | 244/33 |
| 1,660,341 | A | | 2/1928 | Lapworth | |
| 1,725,250 | A | | 8/1929 | Burgess | |
| 2,134,987 | A | * | 11/1938 | Shors | 40/215 |
| 2,178,551 | A | * | 11/1939 | Almgren | 446/51 |
| 2,225,103 | A | | 12/1940 | Einermann | |
| 2,270,753 | A | | 1/1942 | Fikes | |
| 2,377,219 | A | * | 5/1945 | Ellis | 116/173 |
| 2,427,047 | A | | 9/1947 | Ellis | |
| 2,732,823 | A | | 1/1956 | Hanson | |
| 2,870,559 | A | * | 1/1959 | Shaughnessy | 116/173 |
| 3,162,409 | A | * | 12/1964 | Straayer et al. | 116/173 |
| 3,477,161 | A | * | 11/1969 | Drexler | 116/173 |
| 3,749,337 | A | * | 7/1973 | Jalbert | 244/145 |
| 3,820,500 | A | | 6/1974 | Merryweather | |
| 4,768,739 | A | | 9/1988 | Schnee | |
| 5,118,054 | A | | 6/1992 | Kirschenbaum et al. | |
| 5,174,529 | A | * | 12/1992 | Jalbert | 244/145 |
| 5,291,849 | A | | 3/1994 | Zeitler | |

FOREIGN PATENT DOCUMENTS

| | | | | |
|---|---|---|---|---|
| FR | 550588 | | 12/1959 | |
| GB | 2237674 | | 5/1991 | |
| JP | 4-218090 | * | 8/1992 | 116/173 |

* cited by examiner

*Primary Examiner*—Christopher W. Fulton
*Assistant Examiner*—R. Alexander Smith
(74) *Attorney, Agent, or Firm*—Patrick M. Dwyer

(57) ABSTRACT

An artificially enhanced or induced windsource wind accessory device for use with a tethered display device. The wind accessory device has a hollow air director, a natural air intake port, a generated wind port, and an air output port to the banner. Generated wind intake air activates a blocker to close the natural wind intake port. Optionally, the banner is lighted from a light source disposed inside the air director. In an alternate embodiment, the wind accessory device has a perforated tube connected to a wind source and the tube has multiple perforations along the section adjacent to the banner and the perforations face the banner.

9 Claims, 13 Drawing Sheets

WIND ACCESSORY FOR TETHERED DISPLAY DEVICE

This application is a Continuation-In-Part to Ser. No. 08/674,651 filed Jun. 25, 1996 now U.S. Pat. No. 5,826,535.

TECHNICAL FIELD

The invention relates to the field of flags and other display devices; more particularly, it relates to a wind accessory for a tethered display device.

BACKGROUND OF THE INVENTION

Flags and display banners of some type have probably flown, unchanged, for over 5000 years. The conventional flag and banner design has two serious flaws: at low wind velocities, the flag or banner hangs limp or flutters listlessly around its pole; at higher wind velocities, the flag pops and snaps disagreeably, and frays and tatters the end of the flag, promoting relatively short useful life.

So far as I am aware, no one has ever adequately addressed either of these two problems. While there exist a variety of flag hanging apparati, and numerous approaches to dealing with flag drape and tangle problems, there has been no solution proposed for the problems identified above.

What is needed is an improved flag or banner device that, when tethered to an appropriate pole or other anchor, catches or makes use of low velocity wind to fly the device out fully and majestically, while it also stands up to higher velocity winds without snapping or fraying. For low wind conditions, or conditions where there is no natural wind, what is also needed is an air delivery system that automatically directs air from a supplemental wind generator to the banner or tethered display device until a sufficiently strong natural wind blows again.

DISCLOSURE OF THE INVENTION

Accordingly, it is an object of the invention to provide an improved flag or display banner device that, when tethered to an appropriate pole or other anchor, catches or makes use of low velocity wind to fly the device out fully and majestically.

It is a further object of the invention to provide an air delivery system that, when connected between the flag pole and the banner, directs a generated wind to the banner to fly the device out fully and majestically in an absence or insufficiency of natural wind.

It is another object of the invention to provide an automatic means of switching between a "natural" wind when available and a generated wind when "natural" wind is not available, or not sufficient to "fly" the device.

It is a further object of the invention to provide an improved flag or display banner device that, when tethered to an appropriate pole or other anchor, flies in higher velocity winds without snapping or appreciable fraying.

It is another object of the invention to provide a tethered display device, such as a flag or banner, that makes use of a tubular channel integral to the device and made of vertical panels and top and bottom seams that catches and directs low velocity wind to fly the device.

It is another object of the invention to provide a tethered display device, such as a flag or banner, that makes use of a relatively soft airfoil in a tubular channel, both integral to the device that provides lift to the device so that it flies in low winds.

It is yet another object of the invention to meet any or all of the needs summarized above.

These and such other objects of the invention as will become evident from the disclosure below are met by the invention disclosed herein.

The invention addresses and provides such a system. The invention represents the first tethered flag or display device that will fly in very low winds, or, with optional windpole, no wind at all.

Application of the invention to the needs expressed above is especially beneficial in that the invention is the only system that effectively provides both low wind flyability and high wind stability.

The invention provides in one embodiment a tethered display device with at least two vertical panels connected at a top seam and a bottom seam. The panels are preferably cloth or other soft and flexible material. The panels and seams define at least one tubular channel through which air can flow. The two panels can simply be sewn at top and bottom edges to create the channel, or optionally the panels can be connected, such as by sewing, by a top panel and a bottom panel of some suitable width. Because the vertical panels, and top and bottom panels if any, are soft, the device can still "flutter" in a breeze. Preferred devices will take care that they do not therefore become "engorged" with wind (like a conventional windsock), and so eliminate or undermine their ability to so flutter. One way to avoid such engorgement is to fashion the devices without appreciable taper, or other like end attenuation, so as not to "trap" the wind.

In preferred embodiments there are multiple channels in each device. Preferred embodiments will also have at least one soft airfoil horizontally disposed between, and connected to, the two vertical panels. In the simplest airfoil embodiment, the airfoil defines two tubular channels, the one above the airfoil and the one below it; in each airfoil embodiment, an airfoil so defines in part at least one of the tubular channels.

One embodiment has a soft wing-like airfoil that is curved so that a mid portion of the airfoil is closer to the top of the device than are the end portions of the airfoil. A flow of air across and beneath the airfoil thus produces an aerodynamic lift on the airfoil.

In some embodiments there are multiple airfoils. The multiple airfoils can take the form of a single layer of multiple horizontal airfoils, arrayed more or less in "waves" from opening to outlet of the device. In other embodiments, a plurality of horizontally disposed airfoils may be vertically stacked (like a biplane's wings) with respect to each other.

In some embodiments, an airfoil is otherwise unsupported and is air filled (like a sail), and may optionally and advantageously have a permanent 'attack angle' 'sewn in' or otherwise fixed. In other embodiments, there are airfoil fasteners at one or both edges of the airfoil, and the fasteners connect the airfoil to the vertical panels so that the airfoil shape is determined by its fasteners, regardless of whether the foil is 'filled' or not. This fixation and connection helps spread out the lift imparted to the device and prevents an 'end lift only' phenomenon, which can cause undue bending of the foil itself and so cause collapse of the foil and loss of lift.

The airfoil may be directly fastened to the vertical panels such as by sewing or stitching, or by use of grommets or the like, as will be appreciated by those skilled in the art. Alternatively, the airfoil may be indirectly fastened so that the airfoil has at least one edge connected to a vertical panel by a plurality of strings, threads, or other soft connectors as will occur to those skilled in the art, each string having differential lengths cut in advance to suit the filled shape of the foil.

Optionally, the vertical panels themselves are cut with a fullness that allows them to serve as foils themselves so as to provide a 'lift' effect normal to the panels, thus to spread the panels and to laterally tension the horizontally disposed airfoils. This may be necessary in specialty higher wind applications, where high velocities through the channels tend to so reduce channel internal pressure, so that the panels might otherwise tend to collapse inwardly on themselves and the airfoil(s). In such embodiments, the horizontal airfoils may be cut so they are full (filled) only when the vertical panels are full (filled).

In such specialty applications, lateral stiffeners may alternatively be employed to hold the vertical panels apart to prevent vertical panel inward collapse at higher internal air velocities.

The display invention may advantageously and optionally be employed in combinations with some kind of artificially enhanced windsource, such as a funneling device for directing ambient wind into or onto the display device. Optionally, the windsource may be artificially induced, such as by the windpole invention described herein.

The invention also provides a windpole comprising a vertical hollow pole, at least one duct, and at least one port. This windpole may be used as a tether for the display device of the invention and in combination with it. It can be passive, or in little or no wind situations, it can provide enough "wind" itself to fly the display device of the invention. The windpole invention preferably includes a fan, and in some embodiments the hollow pole is itself the duct. The pole has a plurality of in line ports to vent the wind from the pole onto or into the wind channels of the device.

The invention may also provide a separate duct inside the pole that runs roughly parallel with the axis of the pole, with the fan mounted for moving air along the duct, as from a relatively bottom located intake duct, and the pole may advantageously employ a plurality of ports connected by subducts to the main duct.

Where the hollow pole is itself the duct, a plurality of in line ports in the pole may each have an associated scoop to direct airflow to its port. Optionally these scoops may increase in cross sectional area progressively from a bottom scoop to a top scoop. The pole itself may also be internally tapered from bottom to top.

As an embodiment alternative to the vertical internal duct in the pole discussed above, a plurality of roughly horizontally disposed cross ducts in the pole may be employed, with each cross duct having its own fan at one end, and each cross duct ending in one of the ports. The cross ducts may either be tubular, or the ducts may be open horizontally disposed chambers in the pole, so that with an optional rotatably mounted port sleeve having a plurality of in line exhaust ports, each such port roughly aligned with a chamber, and a like plurality of intake ports, each intake port more or less aligned with a corresponding exhaust port and with a particular chamber, the display device when tethered to the port sleeve will act like a wind vane to rotate the intake and exhaust ports into line with the prevailing wind, while the chamber fans draw air through the intake and expel it from the exhaust port into and onto the device. This option is therefore adaptable to provide an air velocity boost to ambient or prevailing air motion, no matter what direction it comes from.

The pole invention may optionally and advantageously have a conventional wind sensor and a fan controller receiving a control signal from the wind sensor so that fan powered air can be attenuated or eliminated as ambient air velocities reach a level sufficient to fly the device without assistance.

The invention provides in one embodiment a wind accessory device to allow the tethered display device or banner to be lifted at all times regardless of the force of natural wind present. The invention comprises a director having air intake ports for both natural wind and generated wind, output ports to the flying banner or display device, an automatic wind source switching mechanism, a means of attachment to a flagpole and a banner, a wind source, and in some embodiments an internal light source.

The invention further optionally has variable internal stiffeners "sleeves", whereby rigidity of the director may be varied. The invention preferably attaches between the flagpole and the banner, and by a variety of means, though the banner and wind director can advantageously be integral to one another. The air intake port for generated wind preferably has an integral modular connector for air inlet from the wind generator. In an alternate embodiment the fan could be placed inside the invention, either in or under the modular connector. A further variation of the invention is to employ a wand or handle beneath and supporting the modular connector so that the invention can be carried by hand, or the handle can be inserted into a weighted base in conventional fashion, or inserted into a base having a battery or AC line power supply. Alternatively, the batteries may be disposed in the handle.

The invention advantageously uses an automatic wind source switching mechanism to allow natural wind to be used when available and select generated wind when natural wind is not available or sufficient. The generated air is directed into the banner through the output ports and is blocked from escaping the natural wind intake ports. When generated wind is shut off, preferably by a controlling wind sensor, natural wind is free to enter the intake ports and pass through to the output ports. In one embodiment flaps are used to do the blocking of the natural wind intake ports. In a preferred embodiment a blocker is turned by the force of generated air passing through a turbine or other vaned wheel mounted in the generated airstream, to which the blocker is rotatably connected. Alternatively generated wind goes through the turbine, the force through its vanes causes it to rotate and lift the blocker with a conventional eccentric or cam to a closed position. When there is no generated wind the turbine is conventionally spring biased to an open position and the blocker falls back and opens the ports. As a further alternative, the turbine wheel is threadably connected to a central shaft so that as the turbine is driven around by the generated wind, it rises up the central shaft and thus pushes up a blocker in riding engagement upon the turbine wheel, or simple turns a blocker mounted on a section of the periphery of the wheel into a blocking position. In either case, because the wheel is free to fall down the shaft when the generated wind is stopped, the blocker is gravity biased into the open position (that is, so positioned that the natural wind port is open). In such embodiments, the generated wind is of sufficient force to effect the movement of the blocker, while still providing enough airflow to the banner to fly it.

The invention optionally allows a banner or tethered display device to be lighted from a light source inside the director, such as a neon or incandescent light.

In an alternate embodiment the invention uses an air supply tube connected to a wind source that runs along a flagpole. The tube is flexible so it can be coiled up in the base of the flag pole. Adjacent the banner, the tube has multiple outlets along the section adjacent to the banner and the outlets face the banner, and direct air to it.

Yet another alternate embodiment of the invention is a method of flying a display device, the method having the step of directing an airflow into a tubular channel in the device, and toward at least one horizontally disposed curved soft winglike airfoil in the device to impart an aerodynamic lift to the airfoil.

BEST MODE OF CARRYING OUT THE INVENTION

Figure 1:
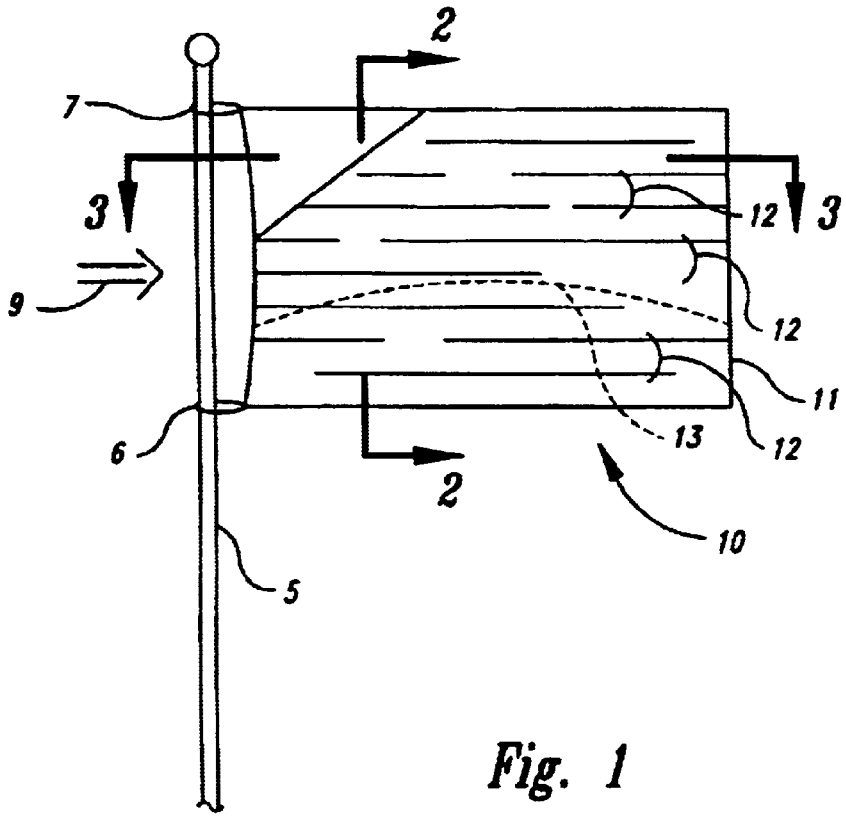
FIG. 1 is a schematic elevation of an embodiment of the invention partially showing hidden features.

In this disclosure the following terms will generally have the following meanings. An airfoil refers generally to an airfoil shaped structure of some soft and flexible material which may either be relatively fixed into a curved airfoil shape, or free to fill and collapse depending on availability of airflow to fill the foil, much like a conventional sail is so dependant. An airfoil in this disclosure also refers to a curved "wing"-like structure that interacts with a flow of air both above and below the airfoil to impart a lift force in a direction normal to the foil in accordance with well known aerodynamic principles. ("Normal" generally has its conventional meaning of more or less perpendicular to the tangent of a given surface.)

Windsource refers to a source of airflow or wind; it may be referred to as enhanced or induced. In a natural sense, ambient breeze or wind may be a windsource; natural wind or breeze may be enhanced, such as by scoops or funnels. In addition to, or instead of, ambient wind, an airflow may be induced, such as by a conventional fan or turbine. A windpole is a device according to the invention by which an induced windsource is created to direct an induced airflow toward a display device such as a flag tethered to the pole structure of the windpole.

A tethered display device refers to a broad class of relatively flexible flags and banners, including conventional flags and banners, but also including the flags, banners and other display devices contemplated in the invention, as further disclosed herein.

Turning now to the drawings, the invention will be described in preferred embodiments by reference to the numerals of the drawing figures wherein like numbers indicate like parts.

FIG. 1 shows a schematic elevation of an embodiment of the invention partially showing hidden features. Pole 5 may be a conventional pole, such as a conventional flagpole, or may be a windpole such as disclosed herein. Tethered display device 10, comprising in the main display device 11, is connected to pole 5 at top tether 7 and bottom tether 6. Display device 11 flies generally in the direction 9 of an ambient airflow. Optional vents 12 generally distally disposed in display device 11 provide an alternate escape for airflow possibly retarded by turbulent buildup, and possibly aid in airflow characteristics at end of display device 11.

FIG. 2, in a set of views a–b, show alternate views of the invention taken along line 2—2 in FIG. 1, to schematically illustrate some of the various positioning possibilities for airfoils 13 between vertical panels 18. In these sectional figures, each airfoil 13 has a lower edge and an upper surface.

Figure 2A:
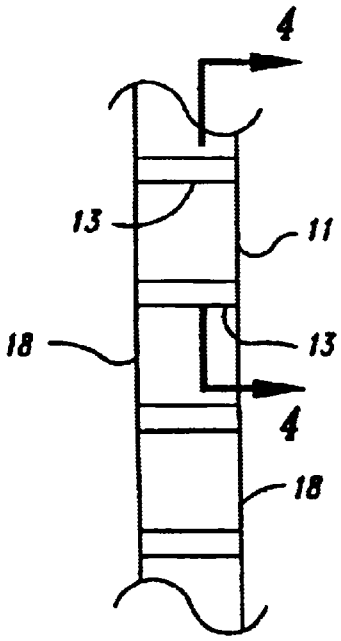
FIG. 2 is set of views a–b, alternate partial and full sectional views respectively of the invention taken along line 2—2 in FIG. 1.
Figure 2B:
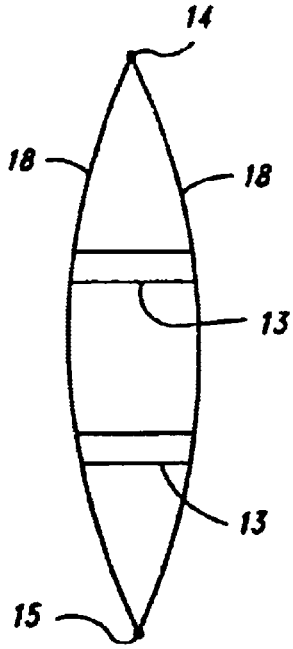

FIG. 2*b* is a sectional view of an alternate embodiment of the invention wherein the two vertical panels 18 are simply connected, preferably by stitching, at top seam 14 and bottom seam 15, with two airfoils 13 preferably stitched in place along the vertical panels, more or less as suggested by dotted line airfoil 13 in FIG. 1.

Figure 3A:
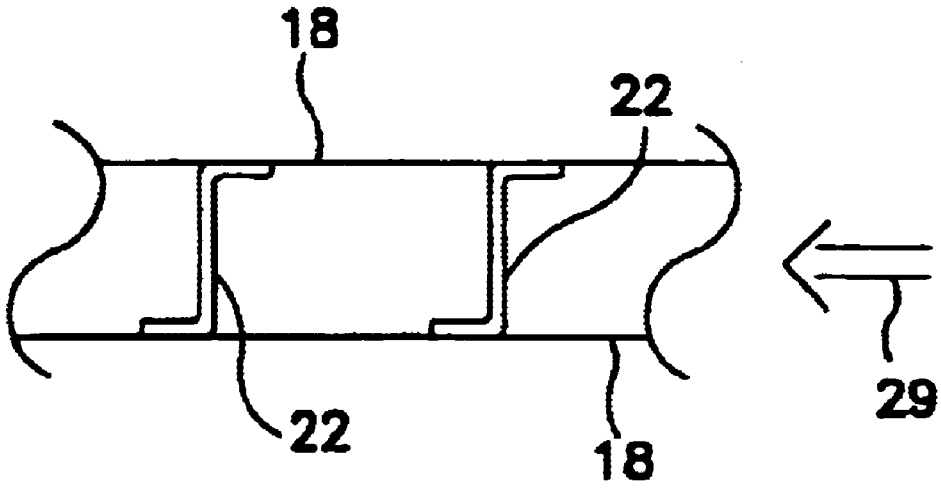
FIG. 3 is a set of views a–b, all in partial sectional view of the invention taken along line 3—3 in FIG. 1.
Figure 3B:
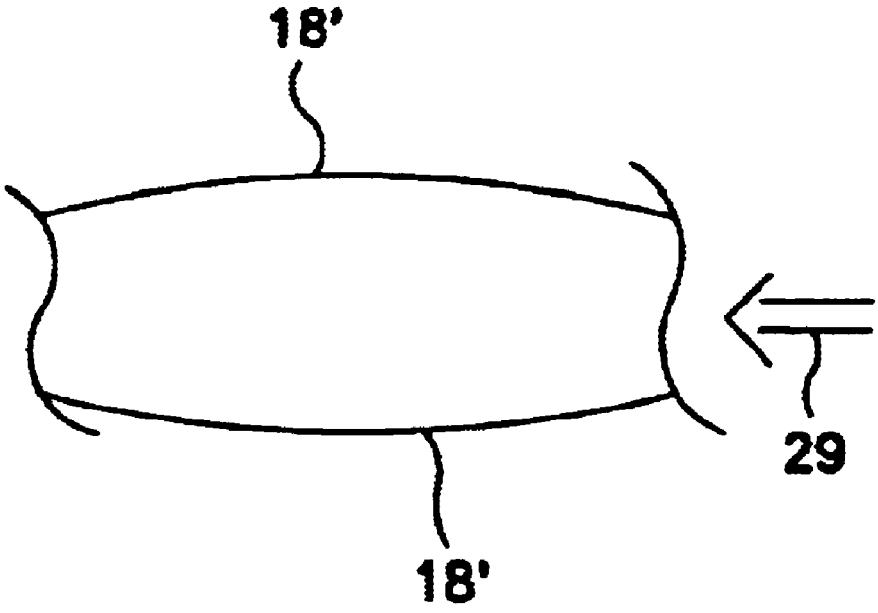

FIGS. 3 *a–b* show sectional aspects of the invention taken along line 3—3 in FIG. 1. In particular, optional lateral supports 22 are shown in place providing support for vertical panels 18 to aid in maintaining separation between the panels and promoting optimal airflow through the display device. Care is taken in selecting materials for supports 22 so that furling and other flag-like characteristics are not unduly attenuated. Alternatively, vertical panels 18 may be cut with a fullness so that they can bow or fill to the shape generally and schematically shown in FIG. 3*b* (18', and optionally serve as airfoils themselves with "lift" forces effective to assist in maintaining separation of the panels. Airflow direction arrow 29 illustrates schematically the airflow through (and around) the device.

Figure 4A:
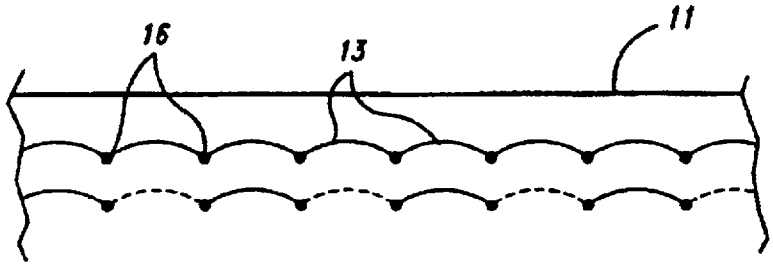
FIG. 4 is a set of views a–d, all in partial sectional view of the invention taken along line 4—4 in FIG. 2*a*.
Figure 4B:
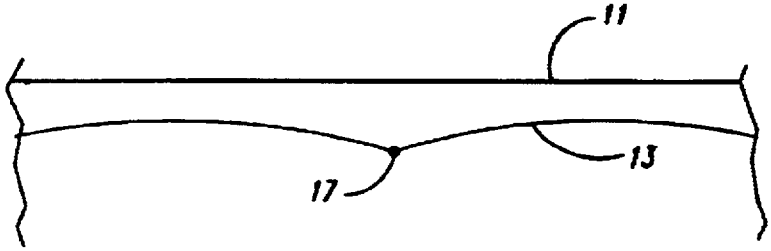
Figure 9:
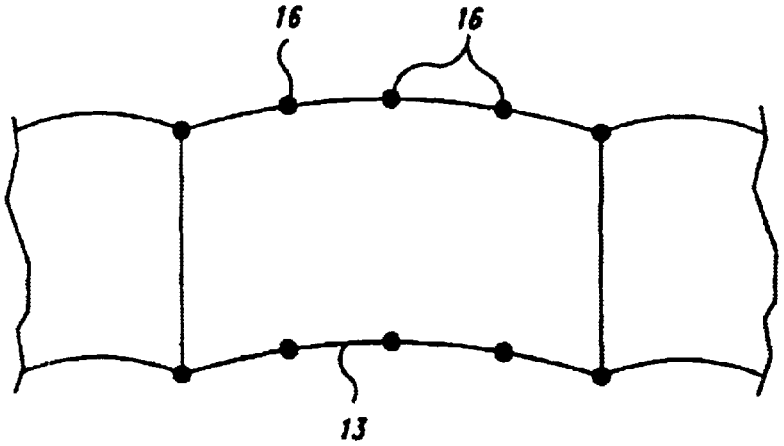
FIG. 9 is a partial perspective view of a detail of the invention taken from FIG. 4*a*.

FIGS. 4*a–d* are alternate schematic sectional views of the invention taken along line 4—4 in FIG. 2*a* to illustrate various positional possibilities and configurations for the airfoils 13 for preferred embodiments. In FIGS. 4*a* and 4*b*, airfoils 13 may be arrayed in series as variously shown, and may be contiguous, or intermittent (shown by dotted line omissions in 4*a*). Airfoils 13 may optionally be attached to panels 18 by fasteners 16, such as grommets or stitching. FIG. 9 is a partial perspective view of a detail of the invention taken from FIG. 4*a* showing one grommet positioning. Fasteners 16 may be on either or both edges of airfoil 13, and may be at any spacing along an airfoil edge deemed appropriate by those skilled in the art. Fasteners 16 can advantageously pre-shape airfoil 13 so that it maintains the same shape in all wind conditions (subject of course to varying sag or droop along the length of the display device, at least under very low winds).

Figure 4C:
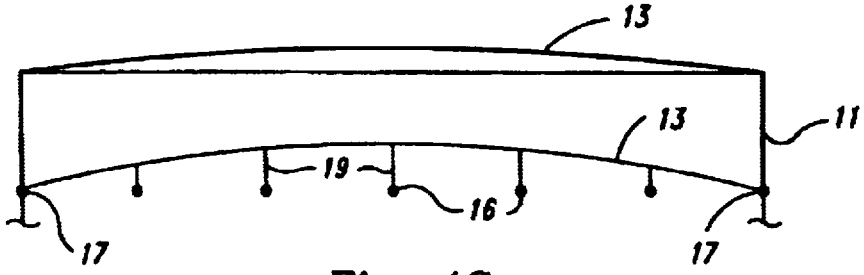

In FIG. 4*c*, a top foil positioning is schematically illustrated, as well as an alternate foil attachment system employing fasteners 16 such as grommets, connecting lines 19 such as string, thread or other line to connect fasteners 16 to an edge of otherwise floating airfoil 13 (attached otherwise to panels 18 only at their airfoil end attachments 17). Lines 19 have differing lengths, as will be appreciated by those skilled in the art, to accommodate the prospective filled shape of the airfoil 13. This latter arrangement serves to allow free wind filling of airfoil 13, while at the same time allowing the airfoil lift to be transferred to the panel (and thus to the display device 11) at positions in addition to the attachment ends 17, so to prevent such sag or other deformations as may occur when lift forces are transferred only at the ends of the foils.

Figure 4D:
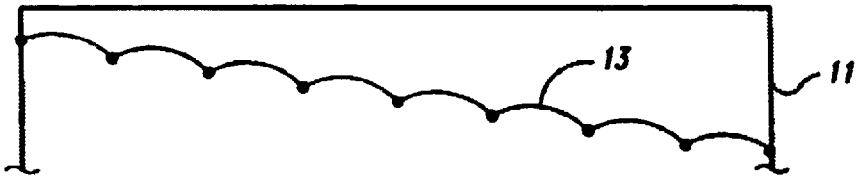
Figure 5A:
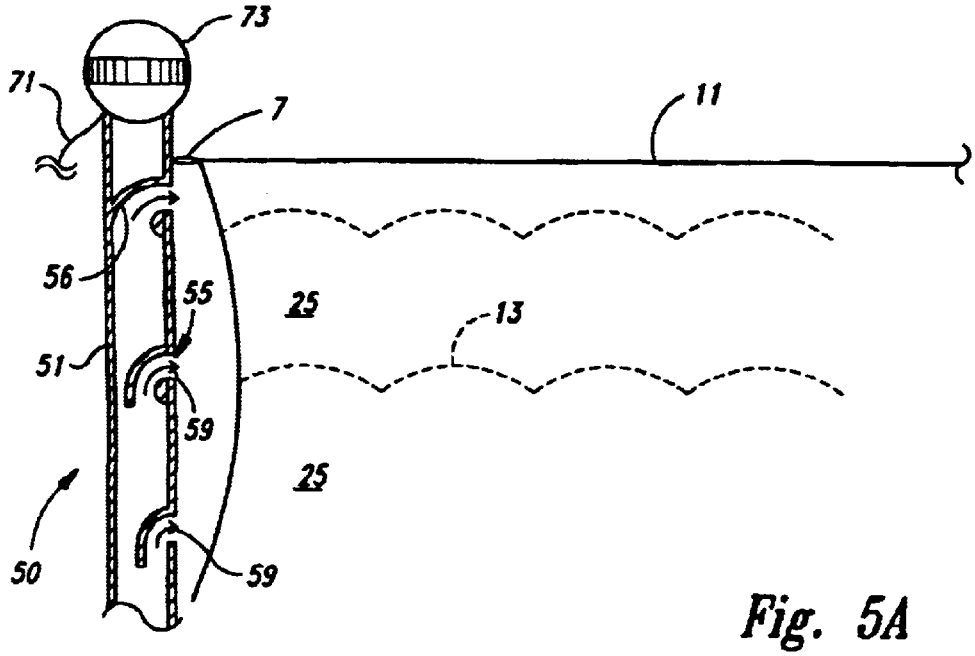
FIG. 5 is a set of partial cross section views a–f of another aspect of the invention.
Figure 5B:
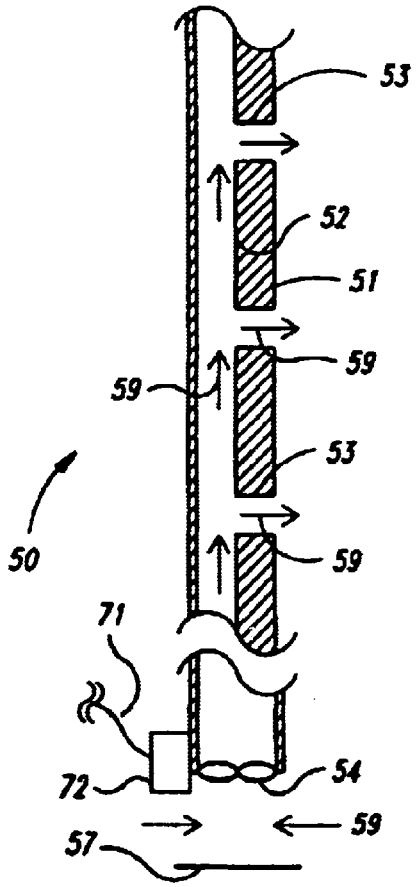
Figure 5C:
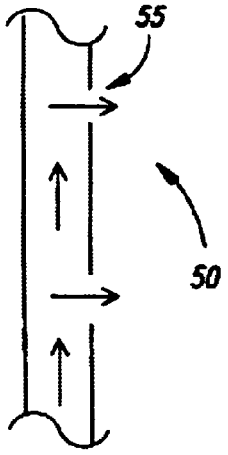
Figure 5F:
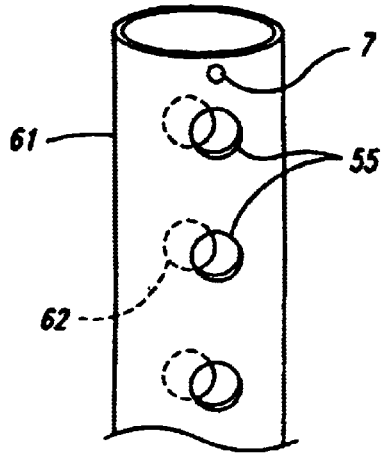
Figure 5D:
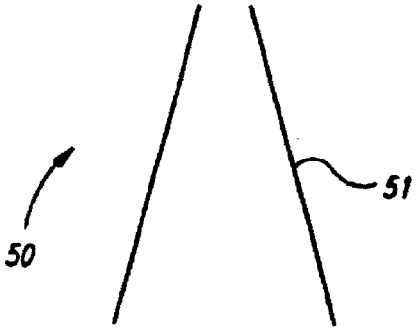
Figure 5E:
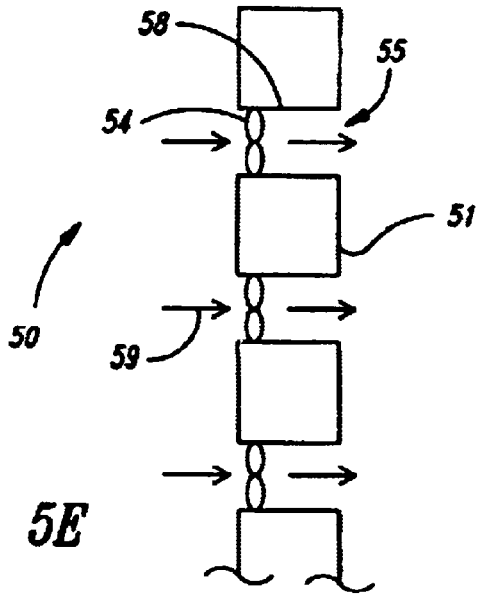

In FIG. 4*d* an optional "ramp" or "attack angle" is illustrated as an aid to maintain the airfoils 13 in a filled state in relatively low winds.

Preferred materials for vertical panels 18 and airfoils 13 and for the display device 11 in general will comport with choices generally familiar to those skilled in the art, such as sail cloth and conventional flag cloth for the panels, and nylon for the airfoils. Widths and other dimensions illustrated are for schematic purposes only. Almost any practical dimensions will serve. A preferred embodiment employs manmade materials, such as a ripstop nylon, such as may be purchased from a kit shop, and has a length/height ratio of 1.5 to 1.

Figure 6A:
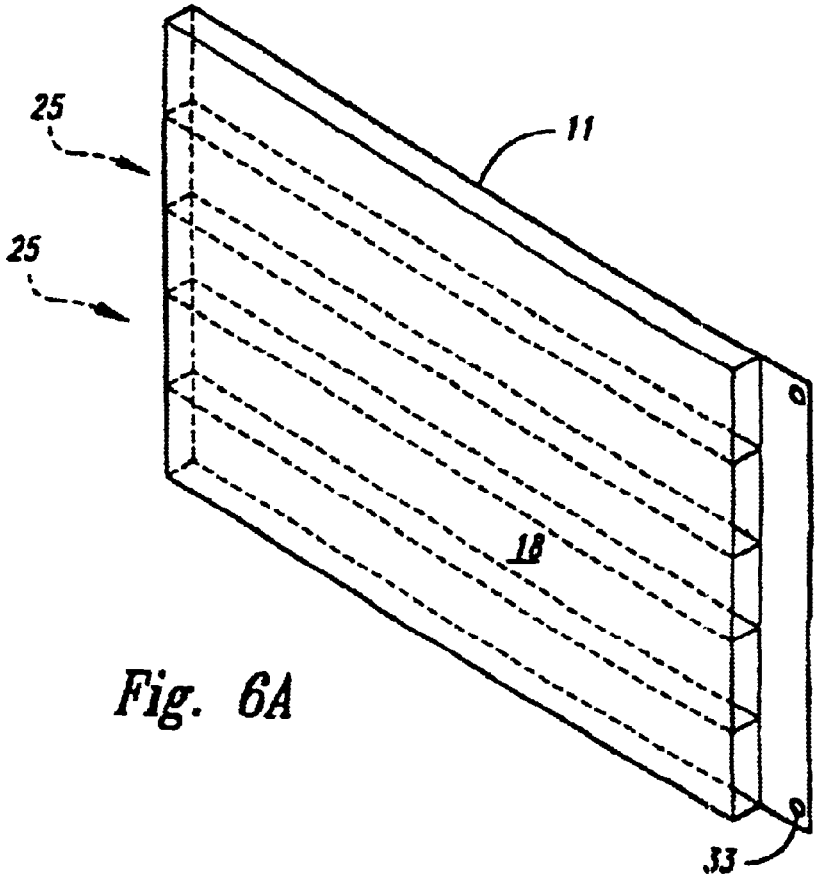
FIG. 6 is a set of views a–b, in perspective and side elevation (showing hidden details), respectively, of an alternate embodiment of the invention.
Figure 6B:
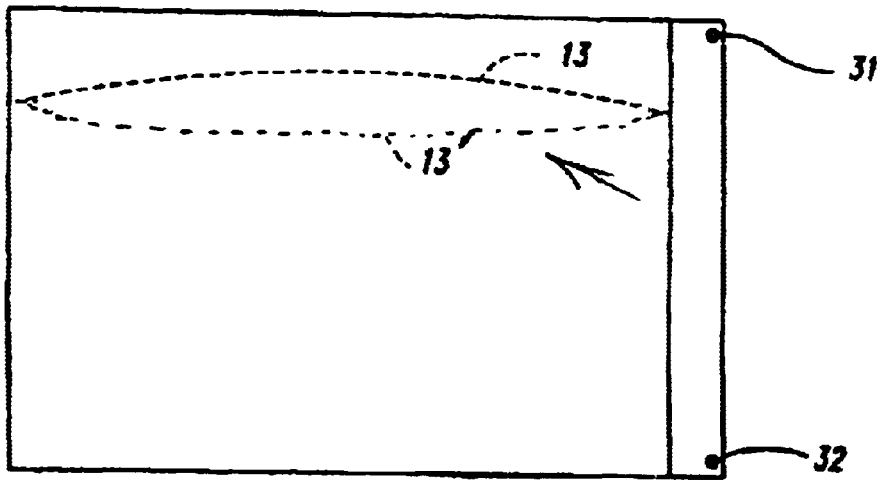
Figure 7A:
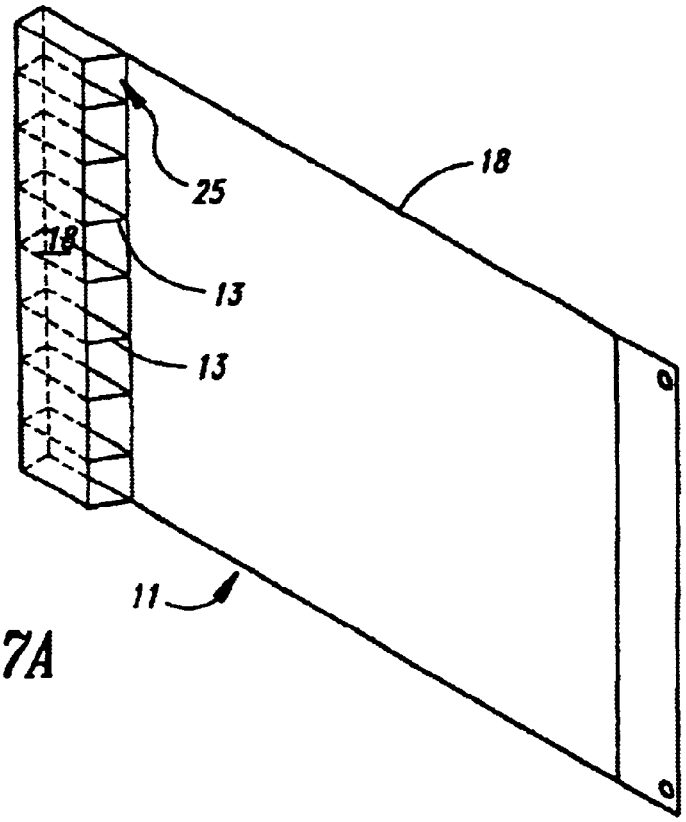
FIG. 7 is a set of views a–b, in perspective and side elevation (showing hidden details), respectively, of an alternate embodiment of the invention.
Figure 7B:
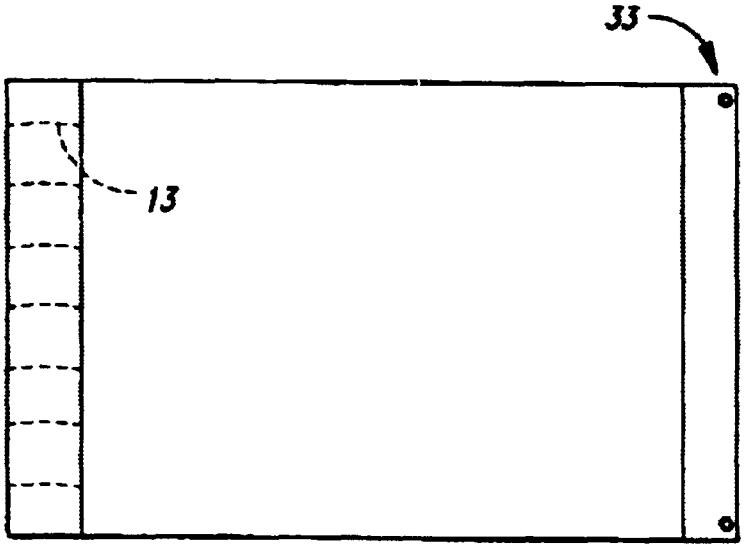

FIGS. 6, 7 and 8 are set of views a–b, in perspective and side elevation (showing hidden details), respectively, of alternate embodiments of the invention. Each embodiment employs a tether tab 33 having top tether point 31 and bottom tether point 32 for tethering display device 11 to some anchor point such as a pole or other vertical structure. Various two panel, multiple channel embodiments are shown. In FIG. 6, both vertical panels 18 are the same size, and multiple airfoils 13 divide the space between the panels into multiple channels 25. Airfoil 13 at rest is shown schametically as dotted line 13'.

In FIG. 7 one panel 18 is shorter than the other, resulting in shorter channels 25 and shorter airfoils 13. This embodiment is believed to be useful in situations where there are generally steadier and more vigorous winds prevailing. It is thus believed it is sometimes advantageous for panels 18 to be different sizes.

Figure 8A:
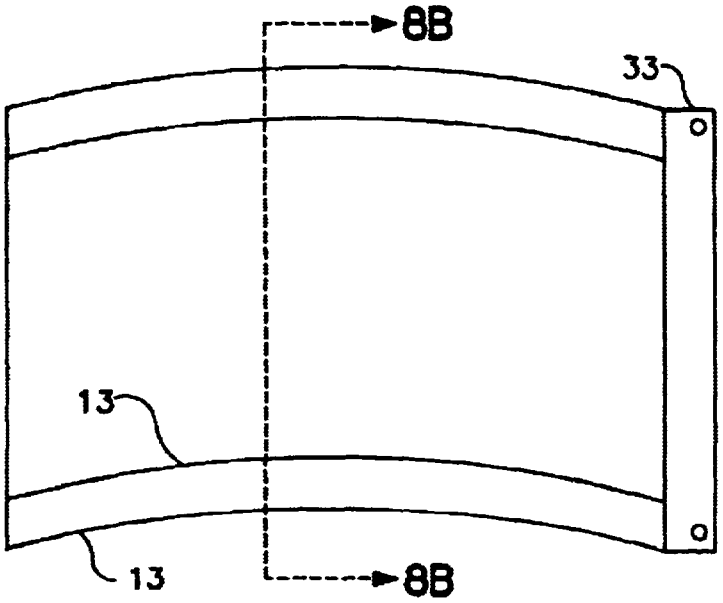
FIG. 8 is a set of views a–b, in side elevation and cross section, respectively, of an alternate embodiment of the invention.
Figure 8B:
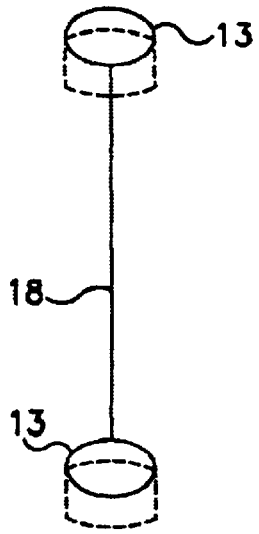

In FIG. 8*a* a variation is shown where a portion of one panel 18 is cut and folded in such a way that, when attached to the other panel, it forms a generally rounded cross section curved tubular channel, the upper and lower surfaces of which are believed to function themselves as airfoils 13. Optionally, a single panel 18 may be combined with separately cut and formed curved tubular channels, which may be attached to the top and bottom of the panel 18 FIG. 8*b*.

It should be noted that in any embodiment, there may be more than two vertical panels, and "vertical" does not require absolute verticality. As the airfoils 13 are in general for creating lift to counteract the pull of gravity so that the flag flies in all winds or no wind, it is necessary in general for the panels disposed on either side of the airfoils to be generally vertical (that is, generally parallel to the pull of gravity acting normally to the earth), so that airfoils 13 may thereby be appropriately and generally horizontally disposed. Minor variations can be tolerated, however, as will be appreciated by those skilled in the art. Optional handle 129 is provided with optional batteries 130.

A preliminary testing of a relatively simple embodiment of the invention at various wind velocities demonstrates that the display device 11 of the invention manifests near constant lift and furl from almost no wind (<5 mph) to relatively stiff breezes (>25 mph). In addition, some waving was also noted even at the greater velocities. A control flag of comparable dimension was also flown near the test flag, and it hung limply until wind velocity became elevated (>10 mph), shortly after which as wind exceeded 20 mph, it began to pop and snap violently, and lost its "wave".

FIGS. 5*a–f* show alternate schematic partial cross section views of the windpole aspect of the invention. Windpole 50 has optional windsensor 73 and fan controller 72 connected by wire 71 to control optional fan 54. Fan 54 draws air in at pole base 57 and airflow 59 (shown as arrows generally throughout FIG. 5) is directed through duct 52 in hollow pole 51 to exhaust at ports 55 via subducts 53. As shown, ports 55 are generally lined up with channels 25 between airfoils 13 of display device 11. Alternatively, pole 51 is hollow and without ducts or subducts, and instead employs scoops 56 to direct airflow 59 to ports 55. It is believed it may be advantageous to have scoops 56 vary in cross sectional area, increasing from bottom scoop to top scoop, to compensate for possibly attenuating airflow velocity as the distance from the fan increases. Alternatively, the pole 51 may be internally tapered as schematically illustrated (exaggerated) in FIG. 5*d*. Poles without scoops or ducts may also optionally be employed.

In an alternative embodiment, instead of vertical ducting or vertically hollow poles, horizontally disposed ducts or chambers 58 may be employed, each having a port 55 aligned with a chamber 25. Each duct 58 may have its own fan 54 mounted within. Where horizontal chambers 58 are employed, an optional pole sleeve 61 may be rotatably mounted encircling pole 51. Pole sleeve 61 has ports 55 and intakes 62 (hidden), both aligned with chambers 58 and with chambers 25 in display device 11. Fan(s) 54 may be mounted inside pole sleeve 61 at intakes 62 and rotatable with it, so that airflow 59 may be drawn in intake 62 by fan 54 to fill chamber 58 (formed in part by chamber 58 in pole 51 and by pole sleeve 61) to exhaust at ports 55. This embodiment allows display device 11 to be tethered at tethers 6 and 7 on pole sleeve 61, so that device 11 is free to swing to the direction of ambient wind, while still able to take maximum advantage of induced airflow from the windpole.

Figure 10:
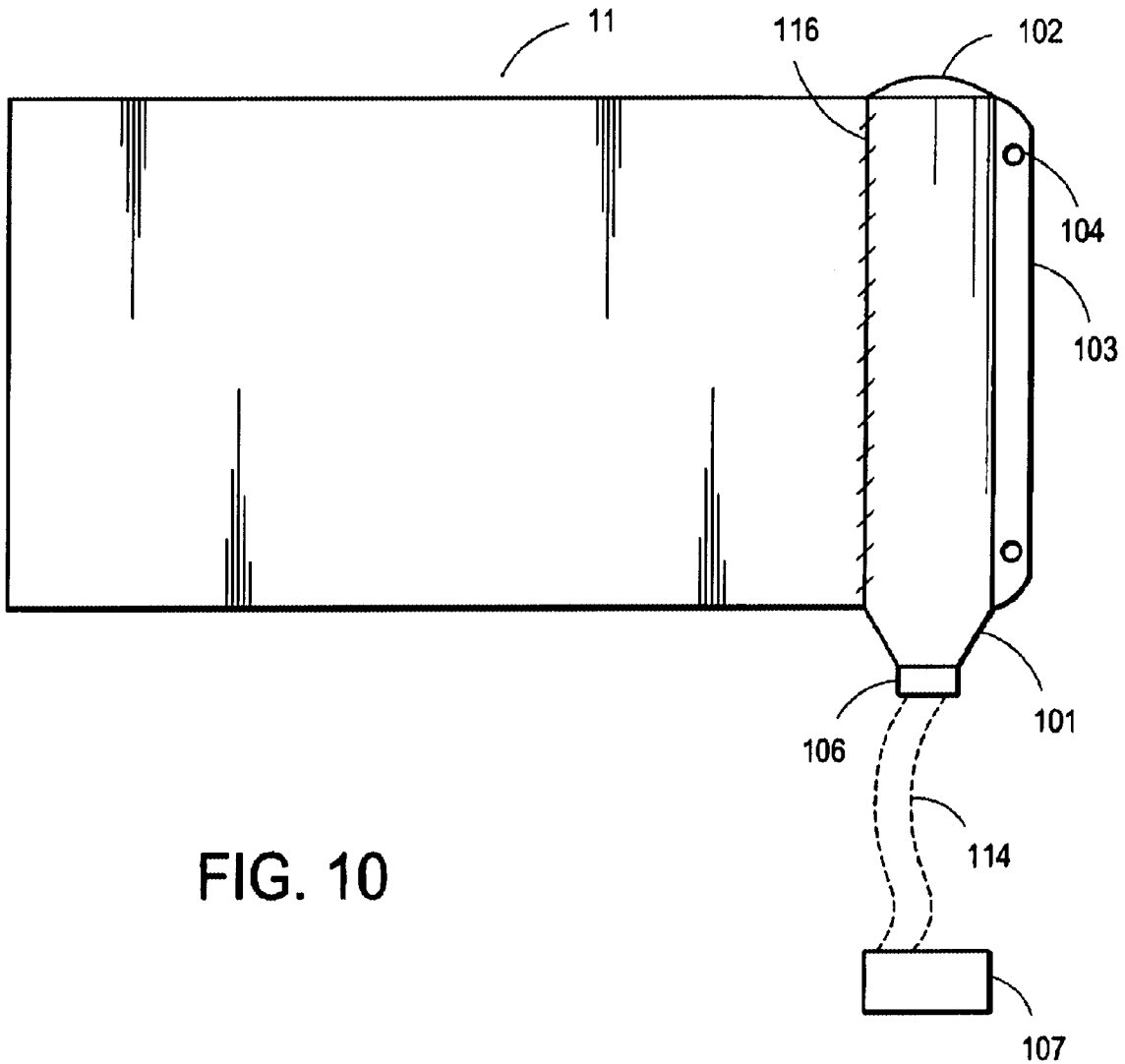
FIG. 10 is a side view of an alternate aspect of the invention.

FIG. 10 shows a side view of one embodiment of the invention. The wind delivery device or director 101 is attached to banner or display device 11 in any of several conventional ways, sewing 116 preferred, and removably attached to flagpole 111 via flagpole attachment holes 104. The director is a rigid device of any dimension and made of materials 103 either the same or similar to that of the banner. The device is closed on top with cap 102. At the bottom of the invention is a modular connector 106 for attachment to an air hose 114 connected to an external wind generator source such as a fan 107. The modular connector is adapted to receive any size and style of hose 114 for conveying the generated wind 109.

Optionally, connector 106 may hold a self contained fan unit (not shown), and may then be used with or without hose 114. The air hose 114 is of any type and may vary in width and length to deliver the necessary pressure, as will be appreciated by those skilled in the art. The external wind generator 107 could be located anywhere within reason. In an alternate embodiment the wind generator 107 could be placed internally in the bottom of the director.

Figure 11:
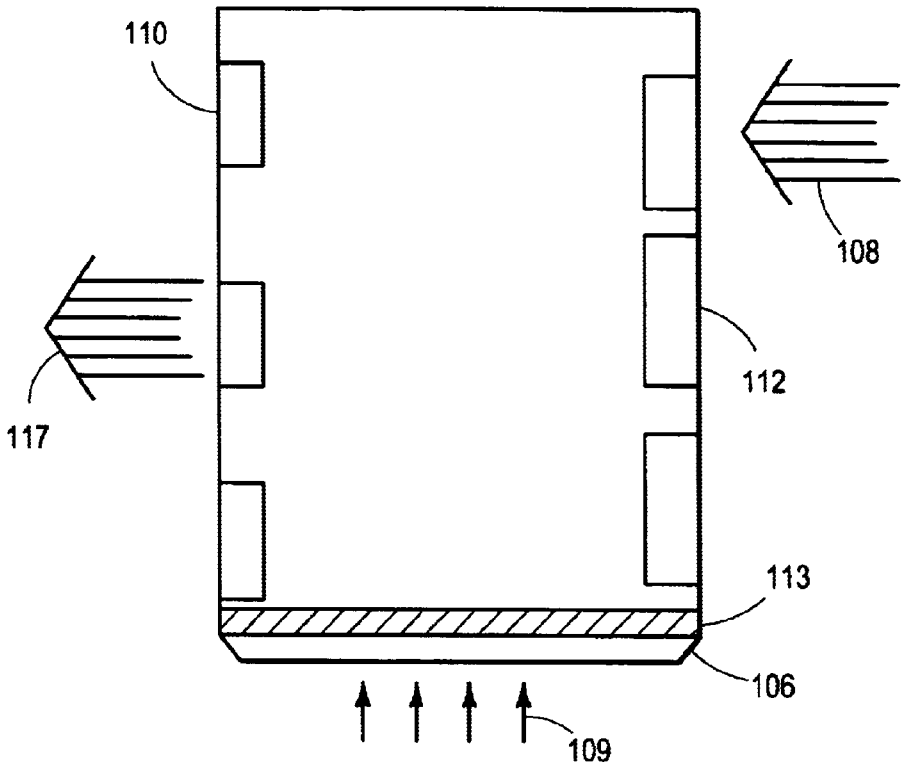
FIG. 11 is a cutaway side view of the invention shown in FIG. 10.

FIG. 11 illustrates an internal side view of director 101. Air can enter director 101 in one of two forms, natural wind 108 or generated wind 109. Natural wind 108 would, when available, enter through ports 112, and generated wind 109, when produced, through the module connector 106 at the bottom of the invention. In one embodiment, when there is insufficient or no natural wind 108 detected by a wind sensor (not shown), generated wind 109 would go through a turbine 113. This turbine, shown in detail in FIG. 12, directs the generated wind 109 to the output ports 110 for air delivery 117 to the tethered display device 11 or banner, while blocking the generated wind 109 from escaping through the natural wind intake ports 112. When generated wind 109 is shut off, natural wind 108 enters director 101 through natural wind intake ports 112 and flows through to output ports 110.

Figure 12A:
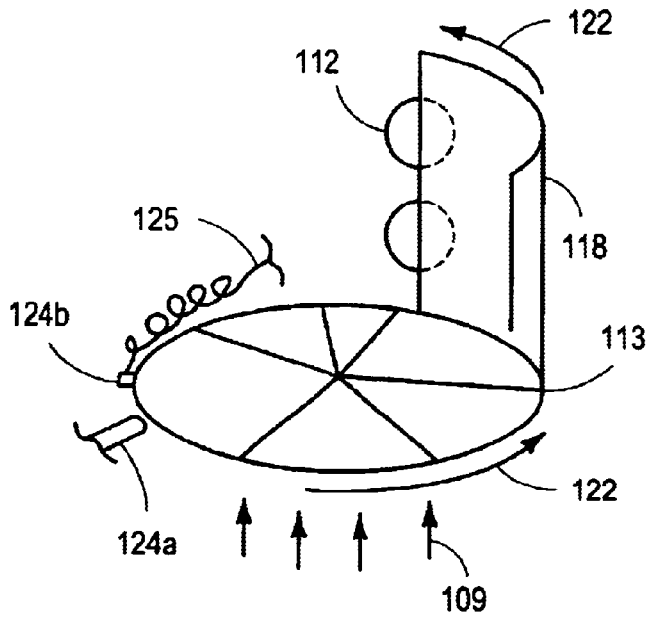
FIGS. 12*a–b* are perspective schematic views of details of the invention shown in FIG. 10.

FIG. 12*a* schematically shows one embodiment of an aspect of the wind director 101 of the invention. Blocker 118 is operably connected to turbine 113 and is turned in the direction of arrow 122 by the force of the generated wind 109 passing through turbine 113 which is rotatably mounted generally in the generated airstream 109 for rotation in the direction of arrow 122 against the urging of bias spring 125. Turbine 113 has a stop 124*b* which cooperates with director mounted stop 124*a* to limit the rotation of turbine 113 and blocker 118. Blocker 118, when rotated into a closing position by turbine 113, prevents the generated air from escaping through natural wind intake ports 112. When sufficient natural wind is detected by a wind sensor (not shown), the generated wind 109 is discontinued and blocker 118 rotates back under the influence of spring 125 to its previous position, thus opening natural wind intake port 112.

Figure 12B:
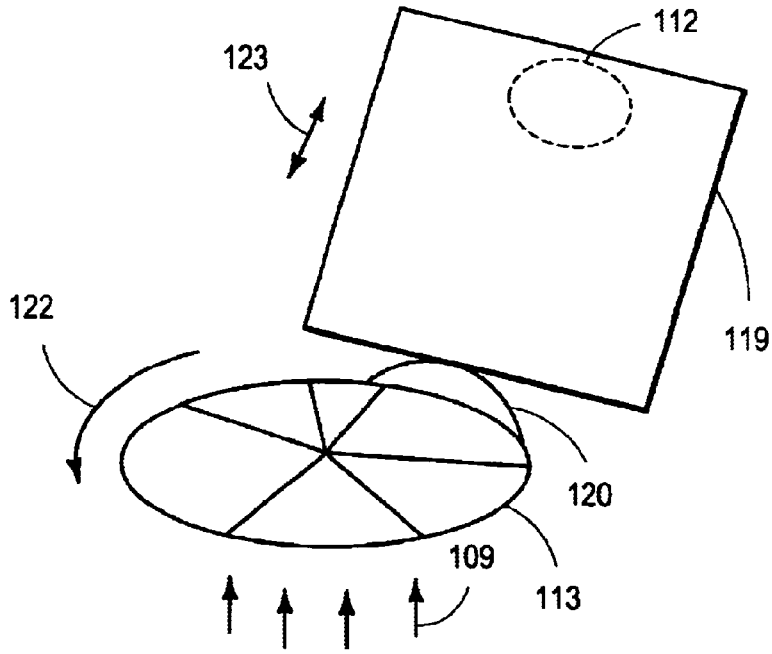

FIG. 12*b* shows an alternate embodiment of the wind director. Generated wind 109 passes through axially mounted turbine 113, and the force through its vanes causes it and attached eccentric or cam 120 to rotate in the direction of arrow 122 and lift the blocker 119 which is slidably mounted for movement in the directions of arrow 123 to close natural wind intake port 112. When there is no generated wind, turbine 113 and cam 120 return under the influence of bias spring 125 (not shown, see FIG. 12*a*) and blocker 119 falls back and opens natural wind intake port 112.

Figure 16:
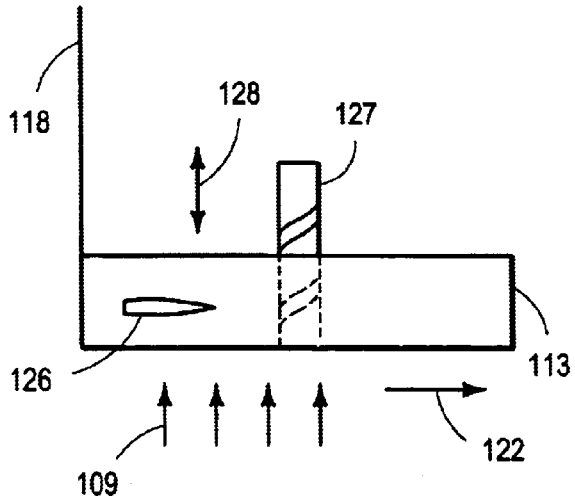
FIG. 16 is a side elevation of an aspect of the blocker of the invention.

Alternately, as shown in FIG. 16, turbine 113 is threadably axially engaged on threaded screw axis 127. As generated wind 109 passes through turbine blade 126, it urges turbine 113 to turn in the direction of arrow 122, which in turn causes the whole turbine to rise upwardly against gravity in the upward direction of arrow 128, thus rotating and lifting blocker 118 into blocking cooperation with natural wind port 112 (not shown). When generated wind is discontinued, turbine 113 rotates and falls downwardly under the influence of gravity in the direction of arrow 128 to its initial position.

Figure 13:
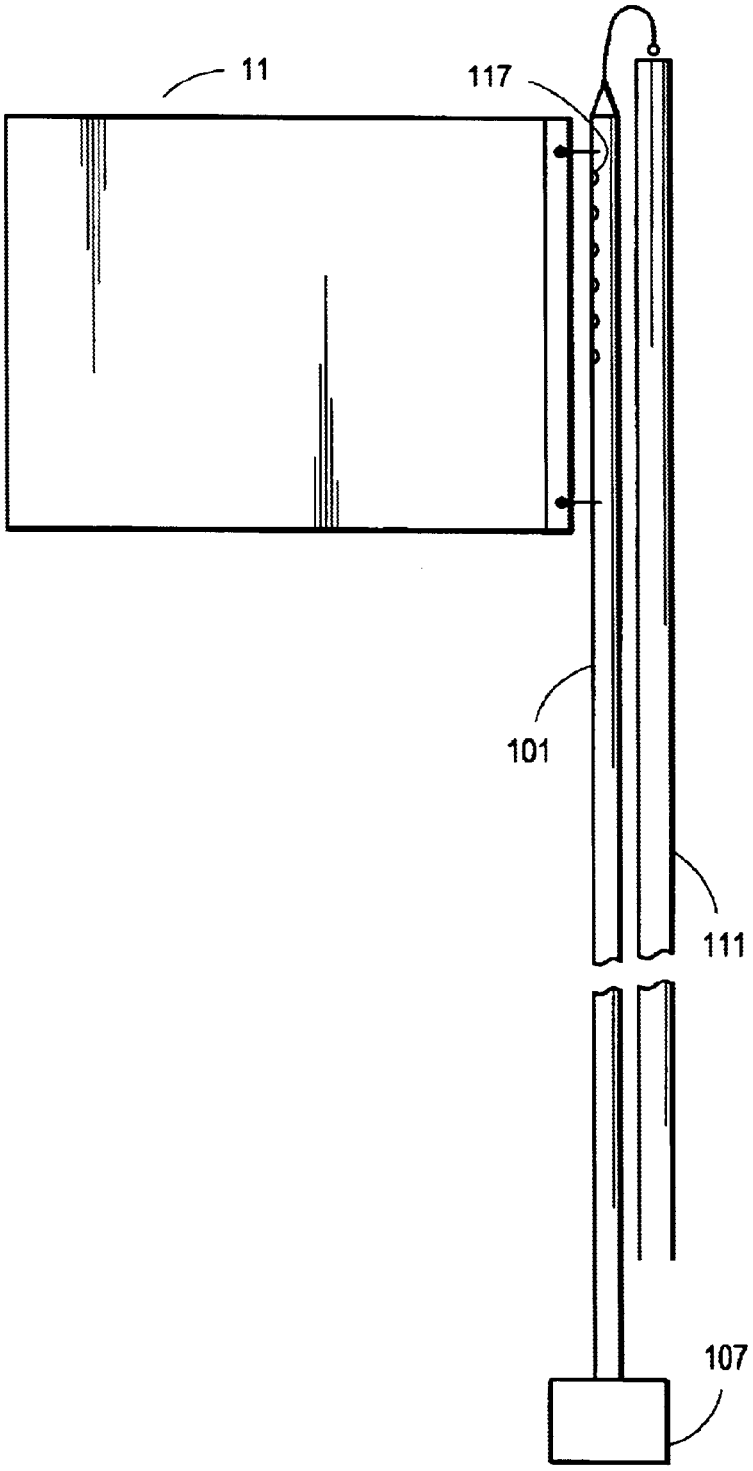
FIG. 13 is a side view of an alternate embodiment of the invention.

FIG. 13 shows a side view of an alternate embodiment of the invention. In this embodiment, director 101 is a long hollow hose removably attached between the tethered display device 11 and flagpole 111 with air holes 117 on the banner side of the invention 101 for air delivery to the tethered display device 11 and an external generated wind source 107 connected to the bottom end of director 101.

Figure 14:
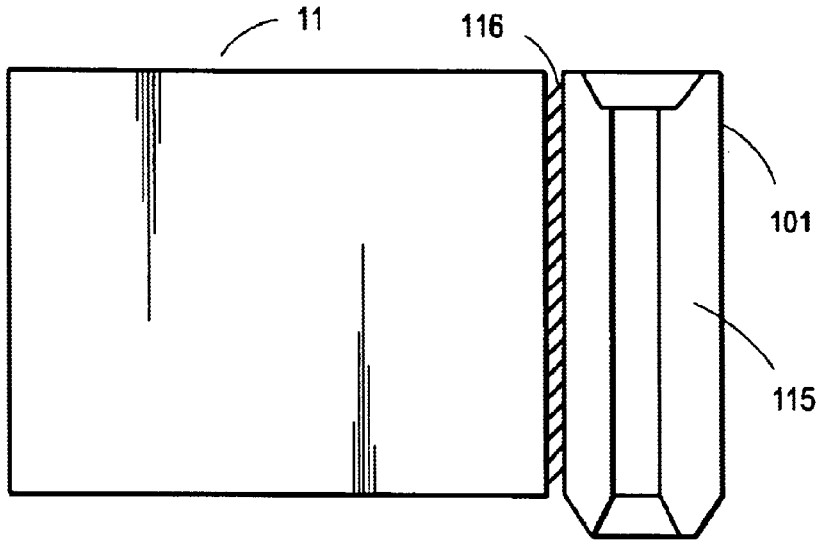
FIG. 14 is a cutaway side view of an alternate detail of the invention shown in FIG. 10.

FIG. 14 shows another embodiment of the director 101 with an internal light source 115 that when turned on would illuminate the tethered display device 11 sewn to it at 116.

Figure 15:
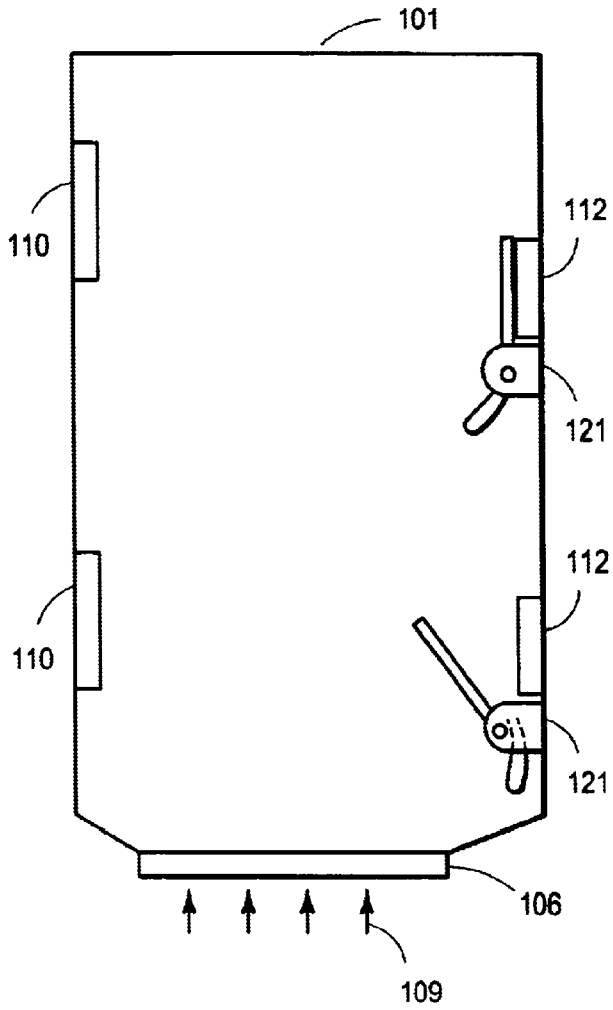
FIG. 15 is a cutaway side view of the embodiment of the invention shown in FIG. 10.

FIG. 15 shows a side view of an alternate embodiment of the wind director of the invention. As generated wind 109 flows through modular connector 106, it flows through the director 101 urging flaps 121 to close against natural wind intake ports 112, preventing generated wind 109 from escaping through these ports as it flows to the output ports 110. When there is no generated wind 109, flaps 121 are spring (not shown) or gravity biased in a manner that will be known to those skilled in the art to open to their normal position.

With regard to systems and components above referred to, but not otherwise specified or described in detail herein, the workings and specifications of such systems and components and the manner in which they may be made or assembled or used, both cooperatively with each other and with the other elements of the invention described herein to effect the purposes herein disclosed, are all believed to be well within the knowledge of those skilled in the art. No concerted attempt to repeat here what is generally known to the artisan has therefore been made.

INDUSTRIAL APPLICABILITY

The flag and display device of the invention may be used throughout the world wherever flags are flown, and as well in all places and for all purposes for which flying banners are used, including outdoor and indoor advertising.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

I claim:

1. An assembly comprising a banner a pole, and a wind accessory device removably attached between the banner and the pole, the device comprising a hollow air director with an air output port therein and a natural air intake port therein the natural air intake port being positioned in the side of the air director that is generally opposite to a side of the air director having the output port therein, the air director also having a generated wind intake port for receiving air from a wind generator, and a blocker positioned within the air director to close the natural air intake port the blocker being activated by wind generated from the wind generator to move from a position spaced from the natural air intake port to a position blocking the air intake port.

2. The assembly of claim 1 wherein the generated wind intake port comprises a modular connector connected to the wind generator.

3. The assembly of claim 2 wherein the wind generator is connected to the device by a hose.

4. The assembly of claim 1 wherein the director further comprises a turbine wheel rotatably mounted on a vertical axis shaft in the director.

5. The assembly of claim 4 wherein the blocker is operably connected to the turbine wheel.

6. The assembly of claim 5 wherein the vertical axis shaft has a thread and is threadably engaged with the turbine wheel, and a wind generated rise in the turbine wheel on the thread impart a lifting motion to the blocker to move the blocker into blocking cooperation with the natural air intake port.

7. The assembly of claim 1 wherein the banner is lighted from a light source disposed inside the air director.

8. The assembly of claim 1 further comprising a handle mounted beneath the air director.

9. The assembly of claim 1 further comprising batteries disposed in the handle.

* * * * *

UNITED STATES PATENT AND TRADEMARK OFFICE

CERTIFICATE OF CORRECTION

PATENT NO. : 6,622,649 B1
DATED : September 23, 2003
INVENTOR(S) : Shaw

It is certified that error appears in the above-identified patent and that said Letters Patent is hereby corrected as shown below:

Column 10,
Line 58, change “impart” to -- imparts --.

Signed and Sealed this

Sixth Day of April, 2004

JON W. DUDAS
*Acting Director of the United States Patent and Trademark Office*